US009788104B2

(12) United States Patent
Akino

(10) Patent No.: US 9,788,104 B2
(45) Date of Patent: Oct. 10, 2017

(54) BOUNDARY MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 15/195,129

(22) Filed: Jun. 28, 2016

(65) Prior Publication Data

US 2017/0142514 A1 May 18, 2017

(30) Foreign Application Priority Data

Nov. 17, 2015 (JP) ..... 2015-224664

(51) Int. Cl.

| | |
|---|---|
| ***H04R 1/34*** | (2006.01) |
| ***H04R 1/44*** | (2006.01) |
| ***H04R 1/08*** | (2006.01) |
| *H04R 31/00* | (2006.01) |

(52) U.S. Cl.

CPC ..... *H04R 1/342* (2013.01); *H04R 1/086* (2013.01); *H04R 1/44* (2013.01); *H04R 31/006* (2013.01); *H04R 2201/029* (2013.01)

(58) Field of Classification Search

CPC ..... H04R 1/342; H04R 1/086; H04R 1/44; H04R 31/006; H04R 2201/029; H04M 1/0202; H04M 1/035

See application file for complete search history.

(56) References Cited

U.S. PATENT DOCUMENTS

| | | | | |
|---|---|---|---|---|
| 2,230,500 A * | 2/1941 | Lybarger | ..... | H04R 11/00 381/165 |
| 2,238,741 A * | 4/1941 | Lauffer | ..... | H04R 1/22 181/158 |
| 2,787,671 A * | 4/1957 | Grosskopf | ..... | H04R 1/38 381/174 |
| 3,254,739 A * | 6/1966 | Hardy | ..... | G01N 29/11 73/599 |
| 3,585,317 A * | 6/1971 | Dvorsky | ..... | H04R 7/26 381/338 |

(Continued)

FOREIGN PATENT DOCUMENTS

| | | |
|---|---|---|
| JP | 2006-101314 A | 4/2006 |
| JP | 2008-288933 A | 11/2008 |

*Primary Examiner* — Joshua Kaufman

(74) *Attorney, Agent, or Firm* — Manabu Kanesaka

(57) ABSTRACT

There is provided a boundary microphone inside which a unidirectional microphone unit is contained, the microphone including: a base plate; and a cover plate attached onto an upper face side thereof, wherein a thin and long tubular groove acting as an acoustic tube for making unidirectivity of the microphone unit a narrow directivity is formed on the base plate side, and therein, the microphone unit is contained. In order to prevent liquid from entering the tubular groove from the outside, between a peripheral edge part of the cover plate and the upper face of the base plate, a spacer that is composed of a water repellent thin film material and allows an inside of the tubular groove and outside air to communicate via acoustic resistance with a thin air layer is disposed so as to enclose an entire periphery of the tubular groove.

7 Claims, 4 Drawing Sheets

(56) References Cited

U.S. PATENT DOCUMENTS 5,148,492 A * 9/1992 Uzawa ..... H04R 9/08 181/166
5,373,555 A * 12/1994 Norris ..... H04M 1/05 379/430
5,494,151 A * 2/1996 Kondo ..... B65G 27/02 198/756
6,148,089 A * 11/2000 Akino ..... H04R 5/02 381/355
7,245,733 B2 * 7/2007 Saltykov ..... H04R 25/402 381/322
7,471,802 B2 * 12/2008 Akino ..... H04R 1/086 381/334
7,602,931 B2 * 10/2009 Akino ..... H04R 1/08 381/355
RE42,347 E * 5/2011 Rombach ..... H04R 19/005 367/174
8,045,741 B2 * 10/2011 Yoshino ..... H04R 11/04 381/177
8,103,038 B2 * 1/2012 Akino ..... H04R 1/086 381/334
8,150,087 B2 * 4/2012 Akino ..... H04R 1/02 381/174
8,442,255 B2 * 5/2013 Akino ..... H04R 1/086 381/122
8,442,256 B2 * 5/2013 Yoshino ..... H04R 1/08 381/122
8,520,880 B2 * 8/2013 Akino ..... H04R 1/086 174/350
8,588,452 B2 * 11/2013 Matsui ..... H04R 1/086 381/355
8,699,739 B2 * 4/2014 Matsui ..... H04R 1/406 379/433.03
8,787,592 B2 * 7/2014 Yoshino ..... H04R 1/083 381/111
9,497,546 B2 * 11/2016 Akino ..... H04R 5/027
9,503,808 B2 * 11/2016 Akino ..... H04R 1/342
9,544,680 B2 * 1/2017 Akino ..... H04R 1/326
2003/0100273 A1 * 5/2003 Pedersen ..... H04M 1/0202 455/90.1
2005/0009580 A1 * 1/2005 Konno ..... H04R 1/2892 455/575.1
2005/0117769 A1 * 6/2005 Kondo ..... H04R 1/2892 381/355
2005/0259842 A1 * 11/2005 Akino ..... H04R 1/08 381/369
2006/0078149 A1 * 4/2006 Akino ..... H04R 1/086 381/369
2006/0104470 A1 * 5/2006 Akino ..... H04R 1/04 381/369
2007/0009118 A1 * 1/2007 Kimura ..... H04R 27/00 381/172
2008/0159578 A1 * 7/2008 Akino ..... H04R 1/04 381/361
2008/0232629 A1 * 9/2008 Akino ..... H04R 1/086 381/355
2009/0097686 A1 * 4/2009 Yoshino ..... H04R 11/04 381/355
2010/0246876 A1 * 9/2010 Akino ..... H04R 1/02 381/361
2010/0322450 A1 * 12/2010 Akino ..... H04R 1/086 381/355
2011/0170727 A1 * 7/2011 Akino ..... H04R 3/005 381/361
2011/0182456 A1 * 7/2011 Akino ..... H04R 1/083 381/361
2012/0099752 A1 * 4/2012 Akino ..... H04R 1/086 381/361
2012/0207336 A1 * 8/2012 Matsui ..... H04R 1/086 381/361
2015/0172808 A1 * 6/2015 Furuya ..... G02B 6/0046 381/122
2016/0014491 A1 * 1/2016 Akino ..... H04R 1/326 381/369
2016/0037259 A1 * 2/2016 Akino ..... H04R 5/027 381/26
2016/0044397 A1 * 2/2016 Ozcan ..... H04R 1/028 381/394
2016/0044408 A1 * 2/2016 Akino ..... H04R 1/342 381/92
2016/0286293 A1 * 9/2016 Akino ..... H04R 29/004
2016/0360318 A1 * 12/2016 Tsai ..... H04R 1/086
2017/0142514 A1 * 5/2017 Akino ..... H04R 1/342

* cited by examiner

BOUNDARY MICROPHONE

RELATED APPLICATIONS

The present application is based on, and claims priority from, Japanese Application No. JP2015-224664 filed Nov. 17, 2015, the disclosure of which is hereby incorporated by reference herein in its entirety.

TECHNICAL FIELD

The present invention relates to a flat boundary microphone placed and used on a table, a floor surface or the like, and more in detail, relates to a narrow directional boundary microphone.

BACKGROUND ART

A boundary microphone is also called a surface-mount microphone because of its flat entire shape and is placed and used, for example, on a table, a floor surface or the like in a conference room.

For the boundary microphone, an omnidirectional microphone unit is used in many cases. There can be a case where narrow directivity is required to excellently collect sound even at a distance relatively separate from a sound source.

In such a case, on the boundary microphone, a narrow directional microphone in which an acoustic tube is attached to a unidirectional microphone unit is mounted. In this type of narrow directional microphone having an acoustic tube, a thin and long slit-shaped opening (side opening for sound wave) is provided on the tube wall of the acoustic tube along the axial line of the acoustic tube, an acoustic resistance material is attached to the side opening for sound wave, and a sound wave is taken in the acoustic tube.

Now, on the boundary microphone, liquid (for example, drinking water or the like spilt due to a glass falling) is more often splashed than on a stand-type microphone, a handheld microphone or the like.

In the narrow directional microphone having an acoustic tube, a non-woven cloth, a mesh body or the like is typically used for the acoustic resistance material attached to the side opening for sound wave of the acoustic tube. When the liquid penetrates this, causing wetness, there arises inconvenience of change in directivity characteristics or the similar situation.

Regarding this point, for example, Patent Literature 1 (Japanese Patent Application Publication No. 2006-101314) and Patent Literature 2 (Japanese Patent Application Publication No. 2008-288933) propose that a joint part between a base plate and a cover plate (made of a punching metal) of a boundary microphone and the cover plate undergo water repellent treatment.

However, when a large amount of liquid is splashed thereon, there is a concern that a part thereof enters the inside of the boundary microphone through the holes of the punching metal which is the cover plate and penetrates the acoustic resistance material of the acoustic tube. Hence, in the boundary microphone using the narrow directional microphone having an acoustic tube, there are needed more secure waterproof (water resistant) countermeasures for the acoustic tube.

Accordingly, an object of the present invention is to protect an acoustic tube in particular from liquid entering from the outside, in a narrow directional boundary microphone using a narrow directional microphone having the acoustic tube.

SUMMARY OF THE INVENTION

In order to solve the aforementioned problem, there is provided a boundary microphone according to the present invention inside which a microphone unit is contained, the microphone including: a base plate whose bottom face is formed to be substantially flat; and a cover plate attached onto an upper face side of the base plate, wherein a unidirectional microphone unit is used for the microphone unit, a tubular groove acting as an acoustic tube for making directivity of the unidirectional microphone unit a narrow directivity is formed in any one of the base plate and the cover plate, and the unidirectional microphone unit is contained in the tubular groove, the cover plate is composed of a plate material that has a size to cover the tubular groove and does not allow sound to pass through, and a peripheral edge part of the cover plate is screw-fastened on the upper face of the base plate in a periphery of the tubular groove, and between the peripheral edge part of the cover plate and the upper face of the base plate, a spacer that is composed of a water repellent thin film material and allows an inside of the tubular groove and outside air to communicate via acoustic resistance with a thin air layer is disposed so as to enclose an entire periphery of the tubular groove.

According to a preferred aspect of the present invention, a synthetic resin-made emboss film having a large number of fine projections is used as the thin film material.

Moreover, in order to more enhance water resistance, the peripheral edge part of the cover plate and the upper face of the base plate preferably further undergo water repellent treatment.

Moreover, in order to make the acoustic resistance with the thin air layer adjustable, the thin film material is preferably deformable in its thickness direction with pressure which is exerted in screw-fastening the peripheral edge part of the cover plate.

Moreover, in order to make the directivity sharper, when the unidirectional microphone unit is disposed on a rear end side of the tubular groove, a width of a portion, out of the thin film material, that is disposed on a front end side of the tubular groove is preferably made narrower than a width of another disposed portion.

The present invention includes an aspect in which the tubular groove is formed on the base plate side, and an aspect in which the tubular groove is formed on the cover plate side.

According to the present invention, a sound wave is taken in the tubular groove corresponding to the acoustic tube through a gap (side opening for sound wave) between the peripheral edge part of the cover plate and the upper face of the base plate. Acoustic resistance of the side opening for sound wave is set to be the acoustic resistance with the thin air layer formed by the spacer that is composed of the water repellent thin film material. Hence, even when liquid enters the boundary microphone from the outside, the liquid does not penetrate into the side opening for sound wave and the narrow directivity does not deteriorate.

DETAILED DESCRIPTION

Figure 1:
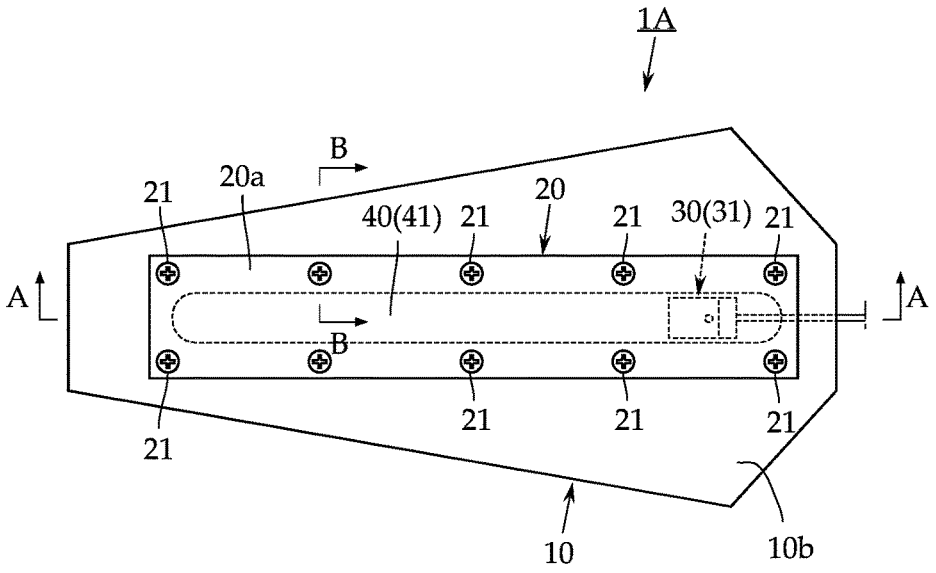
FIG. 1 is a plan view showing a boundary microphone according to a first embodiment of the present invention.

Next, first and second embodiments of the present invention are described with reference to FIG. 1 to FIG. 7, the present invention not limited to these.

First, a boundary microphone 1A according to the first embodiment is described with FIG. 1 to FIG. 5. The boundary microphone 1A includes a base plate 10, a cover plate 20 and a microphone unit 30 for a basic configuration.

The base plate 10 is intended to be stably placed, for example, on a table, a floor surface or the like in a conference room and is composed of a metal or hard synthetic resin material that has considerable weight, and its bottom face 10*a* is formed to be flat. Not shown in the figures, rubber pads may be attached onto the bottom face 10*a*, for example, at its four corners.

Since the boundary microphone 1A is a narrow directional boundary microphone, a unidirectional microphone unit 31 having an acoustic tube 40 is used for the microphone unit 30. In the first embodiment, the acoustic tube 40 is set by forming a tubular groove 41 in the base plate 10.

Figure 2:
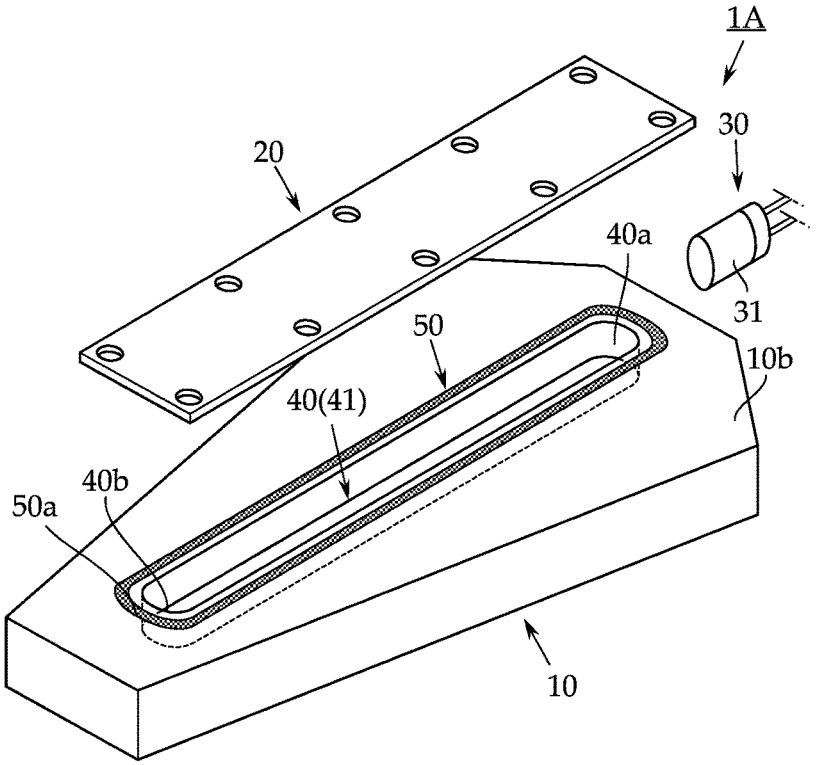
FIG. 2 is an exploded perspective view of the boundary microphone according to the first embodiment.
Figure 3:
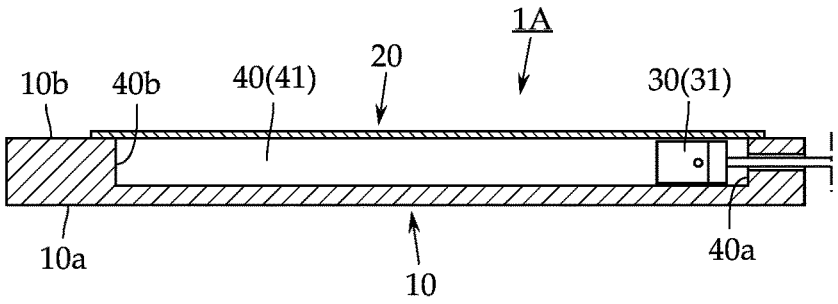
FIG. 3 is a cross-sectional view taken along the A-A line in FIG. 1.
Figure 4:
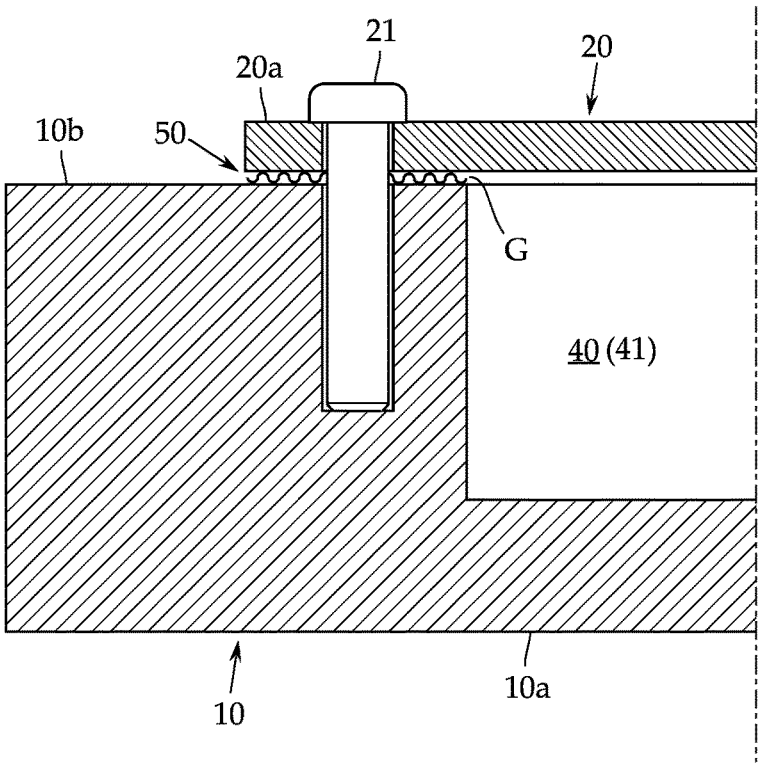
FIG. 4 is a cross-sectional view taken along the B-B line in FIG. 1.

As shown in FIG. 2, the tubular groove 41 is an oval or rectangular groove extending thin and linear, and the unidirectional microphone unit 31 is contained on its one end (rear end as seen from a sound source) side.

The cover plate 20 is composed of an imperforate plate material that does not allow sound to pass through and attached onto an upper face 10*b* of the base plate 10 so as to cover an upper face of the tubular groove 41. The tubular groove 41 functions as the acoustic tube 40 with its upper face covered by the cover plate 20. The material of the cover plate 20 may be any of metal and synthetic resins.

A peripheral edge part 20*a* of the cover plate 20 is screw-fastened on the upper face 10*b* of the base plate 10 with a plurality of screws 21 in the periphery of the tubular groove 41. According to the present invention, a spacer having water repellency which is composed of a thin film material 50 is inserted between the peripheral edge part 20*a* of the cover plate 20 and the upper face 10*b* of the base plate 10.

Figure 5:
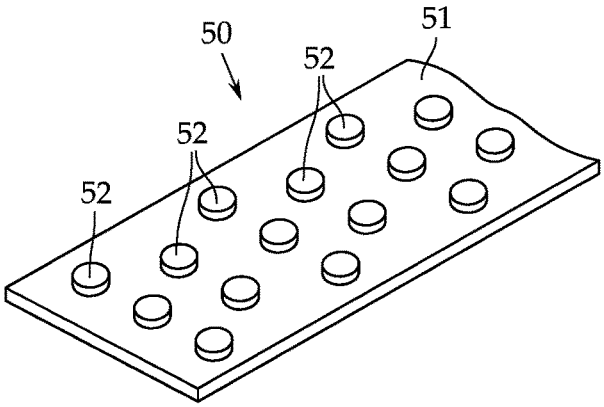
FIG. 5 is an expanded perspective view showing a part of an emboss film used in embodiments of the present invention.

Referring to FIG. 5, for the thin film material 50 having water repellency used as the aforementioned spacer, for example, a fluorine resin film 51 (emboss film) which has a large number of fine projections 52 on at least one surface thereof is preferably employed. Exemplarily presenting this type of emboss film, there is emboss-type one (product number: ASF-119T, CHUKOH Chemical Industries, Ltd.).

In the thin film material 50, a large number of fine columnar projections 52 are provided on its surface. Hence, even when the surface is sandwiched, permeability is present in the planar direction. Notably, the projection 52 is not necessarily columnar but may be a rib-shaped projection as long as permeability is present in the planar direction.

As shown in FIG. 2, the thin film material 50 is thin and long tape-shaped and is disposed so as to enclose the entire periphery of the tubular groove 41. Thereby, as shown in the expanded view of FIG. 4, a spacer function of the thin film material 50 secures a gap G between the peripheral edge part 20*a* of the cover plate 20 and the upper face 10*b* of the base plate 10, and a sound wave is taken in the tubular groove 41 through the gap G.

Namely, the aforementioned gap G corresponds to an opening which is provided on the tube wall of a conventional acoustic tube and takes in a sound wave, and, for example, which is slit-shaped (side opening for sound wave). In the present invention, as acoustic resistance needed for the side opening for sound wave, acoustic resistance with a thin air layer present in the aforementioned gap G, not acoustic resistance with a non-woven cloth or the like, is used.

The thin film material 50 composed of an emboss film can be deformed (expanded and shrunk) in the thickness direction. Hence, screw-fastening pressure with the screws 21 can also adjust the interval of the aforementioned gap G, that is, adjust an acoustic resistance value with the thin air layer.

Notably, the thin film material 50 is disposed across the entire periphery of the tubular groove 41 as above. The width of a portion 50*a*, out of the thin film material 50, that is disposed on a front end 40*b* side of the tubular groove 41 (at an end part opposite to one end (rear end) at which the unidirectional microphone unit 31 is contained) can be made narrower than the width of another disposed portion to make the acoustic resistance value of the relevant portion smaller than the acoustic resistance value of the other portion, which enables the narrow directivity to be sharper directivity.

Moreover, in order to more enhance water resistance, it is preferable that at least the peripheral edge part 20*a* of the cover plate 20 and the upper face 10*b* of the base plate 10 undergo water repellent treatment, for example, PTFE-based (polytetrafluoroethylene-based) one or silicone-based one.

Figure 6:
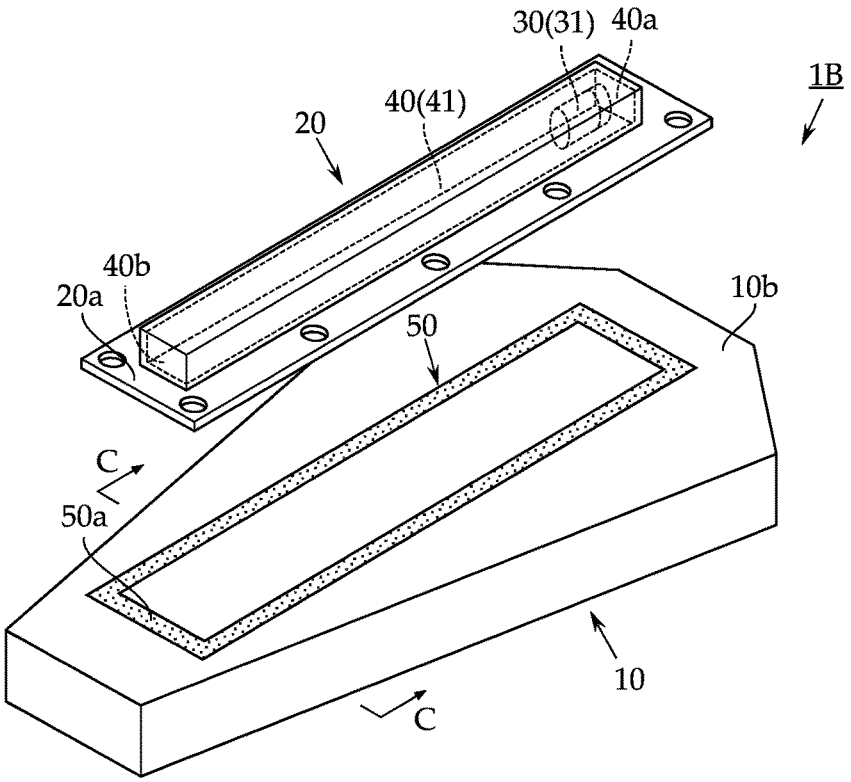
FIG. 6 is an exploded perspective view showing a boundary microphone according to a second embodiment of the present invention.
Figure 7:
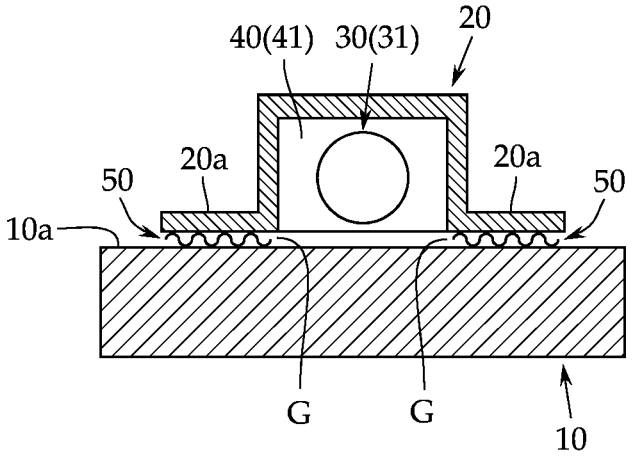
FIG. 7 is a cross-sectional view taken along the C-C line in FIG. 6.

While in the boundary microphone 1A according to the aforementioned first embodiment, the tubular groove 41 constituting the acoustic tube 40 is formed on the base plate 10 side, as in a boundary microphone 1B according to a second embodiment shown in FIG. 6 and FIG. 7, the tubular groove 41 may be formed on the cover plate 20 side. In the second embodiment, the configuration other than that the tubular groove 41 is formed on the cover plate 20 side may be the same as that in the aforementioned first embodiment.

In any of the aforementioned first and second embodiments, between the peripheral edge part 20*a* of the cover plate 20 and the upper face 10*b* of the base plate 10, the gap G corresponding to a side opening for sound wave of a conventional acoustic tube is secured by the thin film material 50 having water repellency, for example, composed of an emboss film, and a sound wave is taken in the tubular groove acting as an acoustic tube through the gap G. By using acoustic resistance with a thin air layer present in the gap G as the acoustic resistance needed for the gap G (side opening for sound wave), an effect is achieved that even when liquid enters the boundary microphone from the outside, the liquid does not penetrate into the side opening for sound wave and the narrow directivity does not deteriorate.

The invention claimed is:

1. A boundary microphone inside which a microphone unit is contained, the microphone comprising: a base plate whose bottom face is formed to be substantially flat; and a cover plate attached onto an upper face side of the base plate, wherein a unidirectional microphone unit is used for the microphone unit, a tubular groove acting as an acoustic tube for making directivity of the unidirectional microphone unit a narrow directivity is formed in any one of the base plate and the cover plate, and the unidirectional microphone unit is contained in the tubular groove, the cover plate is composed of a plate material that has a size to cover the tubular groove and does not allow sound to pass through, and a peripheral edge part of the cover plate is screw-fastened on the upper face of the base plate in a periphery of the tubular groove, and between the peripheral edge part of the cover plate and the upper face of the base plate, a spacer that is composed of a water repellent thin film material and allows an inside of the tubular groove and outside air to communicate via acoustic resistance with a thin air layer is disposed so as to enclose an entire periphery of the tubular groove.

2. The boundary microphone according to claim 1, wherein a synthetic resin-made emboss film having a large number of fine projections is used as the thin film material.

3. The boundary microphone according to claim 1, wherein the peripheral edge part of the cover plate and the upper face of the base plate undergo water repellent treatment.

4. The boundary microphone according to claim 1, wherein the thin film material is deformable in its thickness direction with pressure which is exerted in screw-fastening the peripheral edge part of the cover plate, and the acoustic resistance with the thin air layer is adjustable by the pressure in screw-fastening.

5. The boundary microphone according to claim 1, wherein the unidirectional microphone unit is disposed on a rear end side of the tubular groove, and a width of a portion, out of the thin film material, that is disposed on a front end side of the tubular groove is made narrower than a width of another disposed portion.

6. The boundary microphone according to claim 1, wherein the tubular groove is formed on the base plate side.

7. The boundary microphone according to claim 1, wherein the tubular groove is formed on the cover plate side.

* * * * *